United States Patent [19]

Barret

[11] Patent Number: 4,811,502

[45] Date of Patent: Mar. 14, 1989

[54] SPORT SHOE

[75] Inventor: Thierry Barret, Pringy Gare, France

[73] Assignee: Salomon S.A., Annecy, France

[21] Appl. No.: 58,001

[22] Filed: Jun. 4, 1987

[30] Foreign Application Priority Data

Jun. 6, 1986 [FR] France ..... 86 08257

[51] Int. Cl.[4] ..... A43B 5/04; A43B 5/00; A43B 23/28

[52] U.S. Cl. ..... 36/117; 36/58.5; 36/119; 36/127; 128/166.5; 128/611

[58] Field of Search ..... 36/119, 117, 114, 127, 36/58.5, 50; 128/80 D, 80 H, 166, 166.5, 581, 611

[56] References Cited

U.S. PATENT DOCUMENTS

| | | | |
|---|---|---|---|
| 1,845,031 | 2/1932 | Arthur | 128/166.5 X |
| 1,930,188 | 10/1933 | Arthur | 128/166.5 |
| 2,806,300 | 8/1957 | Morgan, Jr. et al. | 36/58.5 X |
| 4,245,408 | 1/1981 | Larsen et al. | 36/58.5 X |
| 4,282,657 | 8/1981 | Antunious . | |
| 4,461,288 | 7/1984 | Curtis | 128/80 H |

FOREIGN PATENT DOCUMENTS

| | | | |
|---|---|---|---|
| 0057170 | 8/1982 | European Pat. Off. | 36/117 |
| 3336442 | 4/1984 | Fed. Rep. of Germany | 36/117 |
| 3626476 | 2/1987 | Fed. Rep. of Germany | 36/117 |
| 2499834 | 8/1982 | France | 36/117 |

*Primary Examiner*—James K. Chi

*Attorney, Agent, or Firm*—Pollock, Vande Sande & Priddy

[57] ABSTRACT

A flexible-type sport shoe, such as a golf or cross country ski shoe, comprising on the inside three flexible ties (16, 17, 18) to secure the user's foot. One (18) of the ties has two ends (19 and 20) connecting it to the sole (2) of the shoe (1) behind the level of the metatarsal and in front of the level of the calcaneum, respectively on both sides of the shoe, and comprises a section (29) to bypass the foot by the rear between the lower level of the lower attachment of the Achilles tendon to the calcaneum and the lower level of the malleoli. The two other ties (16, 17) have an end connected to the sole of the shoe, respectively on both sides thereof, crossing above the instep, and are deviated by respective guides held by the first tie (18), to present complementary sections (45, 46) to bypass the instepby the frontwhentheyarefastened together, and thus ensure a securing of the foot to the sole (1) when the three ties (16, 17 18) are tightened. The sole (2) is thus firmly secured to the foot, without adverse effects on the comfort of the shoe.

13 Claims, 4 Drawing Sheets

SPORT SHOE

FIELD OF THE INVENTION

This invention pertains to a substantially flexible sport shoe, such as a golf or cross country ski shoe.

BACKGROUND OF THE INVENTION

It is known that this type of shoe must reconcile a requirement of maximum flexibility so that it provides only minimal interference with foot movements, and a requirement that the sole be secured as effectively as possible to the sole of the foot, in general, to afford the user a good degree of stability, and, in the specific case of the cross country ski shoe, to allow precise control of the ski by the foot.

To offset the impossibility of ensuring effective securing of the sole to the sole of the foot through the intermediary of the substantially flexible upper of such a shoe, it has been proposed to dissociate the function of protection and insulation for the foot, which the upper ensures, and the function of securing the sole to the sole of the foot, which, in this case, is ensured by fasteners independent of the upper.

French Patent Application No. 85 12034 discloses a sport shoe, especially intended for cross country skiing, having a flexible upper and a sole as well as means to secure a foot in the shoe, with the securing means comprising the following:

first and second flexible fastening ties, each of which has on the one hand a first end attached to the inside of the shoe, in a lateral zone of the sole located respectively on a first or second side of the shoe and at the metatarsal level, and, on the other hand, successively, beginning with this first end, a first section running laterally along a foot housed in the shoe, at the metatarsal level, inside the shoe and independently of the upper, a second section to bypass the instep respectively up to the second or first side of the shoe, at the metatarsal level, inside the shoe and independently of the upper, with the second sections of the first and second flexible fastening ties being freely superposed, and a second end zone, means for tightening or releasing the first and second flexible fastening ties by the mutual movable fastening of their second end zones, as desired.

In one embodiment of the shoe disclosed in the aforementioned patent application, the first and second flexible fastening ties have, between their second sections and their second end zones, mutually complementary third sections to bypass the foot by the rear, between a lower limit defined by the lower level of the lower attachment of the Achilles tendon to the calcaneum and an upper limit level defined by the lower level of the malleoli, so that the tightening of the first and second flexible fastenings does not impede the extension movements of the foot.

These arrangements are especially effective when it comes to preventing the front part of the foot from pivoting on the sole, which is to be avoided especially in cross country skiing; however, these arrangements allow a certain degree of freedom for the heel with respect to the sole, against which the foot is fastened only at the metatarsal level.

However, for certain sports such as golf, for example, it is indispensable for the whole foot to be perfectly immobilized with respect to the sole, to provide the user with the highest possible degree of stability, i.e., a possibility of precisely controlling his position and movements; such a possibility is also desirable in other sports, and even in cross country skiing.

SUMMARY OF THE INVENTION

The purpose of this invention is to propose a shoe having internal fastening means to secure the foot as effectively as possible to the sole, independently of the upper.

For this purpose, the shoe according to the invention, which has a flexible upper and a sole as well as means for fastening a foot inside the shoe, with said fastening means comprising the following:

first and second flexible fastening ties, each of which has on the one hand a first end attached to the inside of the shoe, in a lateral zone of the sole located respectively on a first or second side of the shoe and at the metatarsal level, and, on the other hand, successively, beginning with this first end, a first section running laterally along a foot housed in the shoe, at the metatarsal level, inside the shoe and independently of the upper, a second section to bypass the instep respectively up to the second or first side of the shoe at the level of the metatarsal, inside the shoe and independently of the upper, with the second sections of the first and second flexible fastening ties freely superposing each other, and a second end zone, means for tightening or releasing the first and second flexible fastening ties as needed by the movable mutual fastening of their second end zones, further comprises a third flexible fastening tie having first and second ends attached to the inside of the shoe, in lateral zones of the sole located respectively on the first and second sides of the shoe, behind the metatarsal level and in front of the level of the calcaneum, first and second sections to run along the side of the foot, at least partially inside the shoe and independently of the upper, respectively from the first and second sides of the shoe, turning towards the rear respectively beginning with the first and second ends of the third flexible fastening tie, and a third section mutually connecting the first and second sections of the third flexible tie, behind the upper and independently therefrom, with said third section of the third flexible fastening running along the foot by the rear between a lower limit level defined by the lower level of the lower attachment of the Achilles tendon to the calcaneum and an upper limit level defined by the lower level of the malleoli, and the tightening means comprise, on each of said first and second sections of the third flexible bracing tie, under the level of the malleoli and inside the shoe, a corresponding guide respectively for deviation and sliding for the second or the first flexible fastening tie, so that the first and second flexible fastening ties have, between their second sections and their second end zones, third sections which are mutually complementary, when said second end zones are fastened together, to bypass the foot by the front between said guides, the tightening of the first and second flexible fastening ties also causing the tightening of the third flexible fastening tie, and the first and second flexible fastening ties on the one hand, the third flexible fastening on the other hand, thus being able to apply the corresponding mutually convergent support forces on the foot, downward against the sole.

Those skilled in the art will readily understand that this type of shoe offers the same possibilities for fastening the foot at the metatarsal level, i.e., the same possibilities for securing the front part of the foot to the sole, as a shoe of the type disclosed in the above-mentioned application, and to which is added a fastening for the rear part of the foot when the first and second flexible ties are tightened, which also causes the third flexible tie to tighten. After such tightening, the second sections of the first and second flexible ties apply stress downward and to the rear on the instep, while the third section of the third tie applies a forwardly descending stress to the foot, and these two mutually convergent stresses result in a stress which is approximately perpendicular to the sole, effectively applying the foot against the latter without causing the foot to tend to slide forward or backward with respect to the sole. The attachment of the first and second flexible ties, on the one hand, and of the third flexible tie, on the other hand, in mutually offset zones of the sole, also prevents any possibility of lateral movement of the foot, especially by rotation with respect to the sole, so that, in a shoe according to the invention, the sole is unitary with the sole of the foot. This results in a great degree of stability for the foot when the latter is to be immobilized with respect to the ground, as is the case in golfing, as well as perfect control of the sole by the foot during dynamic use, as is the case, for example, in cross country skiing, for which a shoe according to the invention offers possibilities of guiding the ski with the foot which are even better than those offered by a shoe of the type disclosed in the above-noted application.

Nonetheless, the shoe according to the invention retains the comfort characteristics of the prior art shoe, because of the judicious choice of the zones where the flexible ties pass with relation to the foot, so that there is no restriction of the extension movements of the foot, and especially of the opening of the tibio-tarsal grip which these movements involve.

According to an especially effective and comfortable embodiment, the third flexible tie as well as at least the first and second sections of the first and second flexible ties are comprised of straps which can come into contact with the foot over a surface large enough so that the stress is distributed over the foot without the excessive compression thereof. For this purpose, one can also advantageously provide for the first and second sections of the first and second flexible ties to be inserted freely between a flexible inside lining of the shoe and the upper thereof, as well as all of the third flexible tie. The third section of the latter, however, can also be placed outside the shoe, and can bypass the upper by the rear on the outside; in this case, the advantage of indirect application against the foot is maintained. Also, when the upper has an opening slit at the instep for putting the shoe on and taking it off, as well as a flexible inside tongue opposite this slit, the second sections of the first and second flexible ties can be inserted freely between the upper and the tongue, which distributes the stress applied to the foot over the latter by means of the second sections of the first and second flexible ties.

The second end zones of the first and second flexible ties are fastened together, and the latter, as well as the third flexible tie, are tightened in an especially simple and convenient manner when at least the third sections of the first and second flexible ties are laces.

Such laces may also constitute the other sections of the first and second flexible ties, as well as the third flexible tie, and, in this case, it would be preferable, for reasons of comfort, to also adopt one of the above arrangements, allowing indirect support of the flexible ties on the foot with distribution of the stress over as much of the surface thereof as possible. However, one could also provide an integral assembly of the flexible ties in the form of straps, with the second end zones of the first and second flexible ties in this case being provided with any known type of mutual fastening means, for example, buckling or mutual attachment of a looped fabric and a hooked fabric according to the technique marketed under the registered trademark "Velcro".

Depending on the case, the tightening of the first and second flexible ties, and the ensuing tightening of the third flexible tie, can be provided for by fastening together the second end zones of the first and second flexible ties, to be independent of any closing system for the upper; however, when the upper has an opening slit at the instep for putting the shoe on and removing it, the upper may also comprise, respectively, on each side of said slit, in the immediate proximity thereof, at least two sliding guides respectively for the third sections of both the first and second flexible ties, so that tightening of the latter by fastening together the second end zones thereof causes said slit to close. However, an additional closing device for the slit can be provided in such a case.

Generally, the upper can comprise at least one sliding and deviation guide for the third section of the first and second flexible ties, in front of the sliding and deviation guides provided on the third flexible tie. However, the third sections of the first and second flexible ties may also be allowed to rest freely on the instep, to which they adapt their positions on their own, whether inside or outside of the upper.

BRIEF DESCRIPTION OF THE DRAWINGS

In order that the invention may be more clearly understood, reference will now be made to the accompanying drawings, wherein several embodiments of the invention are shown for purposes of illustration, and wherein.

DESCRIPTION OF PREFERRED EMBODIMENTS

Figure 1:
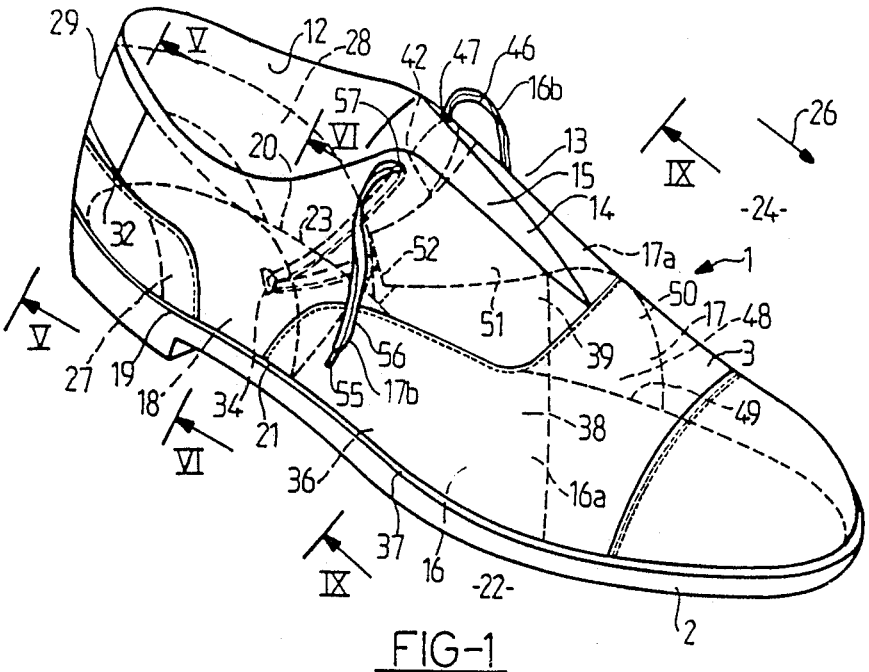
FIG. 1 is a perspective view of a first embodiment of a golf shoe made according to this invention.

While the drawings show a golf shoe, this invention may be applied to other types of flexible sport shoes, for cross country skiing, tennis or other applications in which it is desirable to combine comfort and the mutual solidarization of the sole of the shoe and the sole of the foot.

For reasons of simplicity, the shoes illustrated will be described with reference to a normal forward movement position, and these shoes are assumed to be resting upright on a horizontal plane, according to a normal direction of forward movement.

Reference will first be made to FIGS. 1, 3 to 6 and 9 to 12, illustrating a golf shoe 1 having a flexible sole 2 of traditional design, having towards the top, in an attached manner, a flexible upper 3 for enveloping the phalanges 4, the metatarsal 5 and the tarsal 6 of a foot 7 inside the shoe 1, extending to the area under the malleoli 8. Such a shoe 1 is called a "low top" shoe, but a "high top" shoe, also enveloping the malleoli 8 and a lower zone 9 of the tibia 10 and the fibula (not shown) may also be equipped according to the invention. In such a "high top" shoe, the flexible ties constituting the fastening means characteristic of the invention would be arranged in the same was as in the illustrated "low top" shoe.

The sole 2 and the upper 3 can be of any known type, and can be made of any appropriate material. According to the illustrated embodiment of the invention, the sole 2 and the upper 3 are fully lined, inside the shoe, respectively with an insole 11 and a lining 12, both flexible, and the upper 3 has, towards the front, in a zone 13 corresponding to the instep 40, an opening slit 14 for putting the shoe on and removing it, as well as a flexible inside tongue 15 placed opposite this slit 14 and able to ensure the seal of the upper 3 at the level of this slit 14. These arrangements themselves are known to those skilled in the art, and are not in themselves characteristic of the invention; as such they will not be described in further detail.

According to this invention, the shoe 1 is provided with fastening means, comprised of three flexible ties 16, 17 and 18, the first two of which ensure a fastening of the foot by the front, while the third ensures the fastening of the foot by the rear.

Each of the flexible ties 16, 17 and 18, preferably substantially inextensible, can be fully comprised of a strap or lace, or else can have a combined structure having at least one strap and at least one lace, connected together end to end. In the illustrated example, the flexible tie 18 is comprised of a strap, while each of the flexible ties 16, 17 is comprised of a strap, respectively 16*a* or 17*a*, and a lace, respectively 16*b* or 17*b*, connected together end to end.

The strap constituting the flexible tie 18 has two ends 19 and 20 which are located inside the shoe 1, between the lining 12 and the upper 3 in the preferred example illustrated, and each of which is attached to the sole 2 along a respective lateral zone thereof, namely, a lateral zone 21 located on a first side 22 of the shoe for end 19, and a lateral zone 23 located on the second side 24 of the shoe for end 20.

The lateral zones 21 and 23 along which the ends 19 and 20 of the strap constituting the flexible tie 18 are connected to the sole 2 are located at the level of the tarsal 6 but in front of the calcaneum 25, it being understood that the terms of "front" and "rear" refer to a direction 26 constituting a normal direction of forward movement. They preferably extend over a maximum of the length L between the calcaneum 25 and the tarsal 6.

Figure 4:
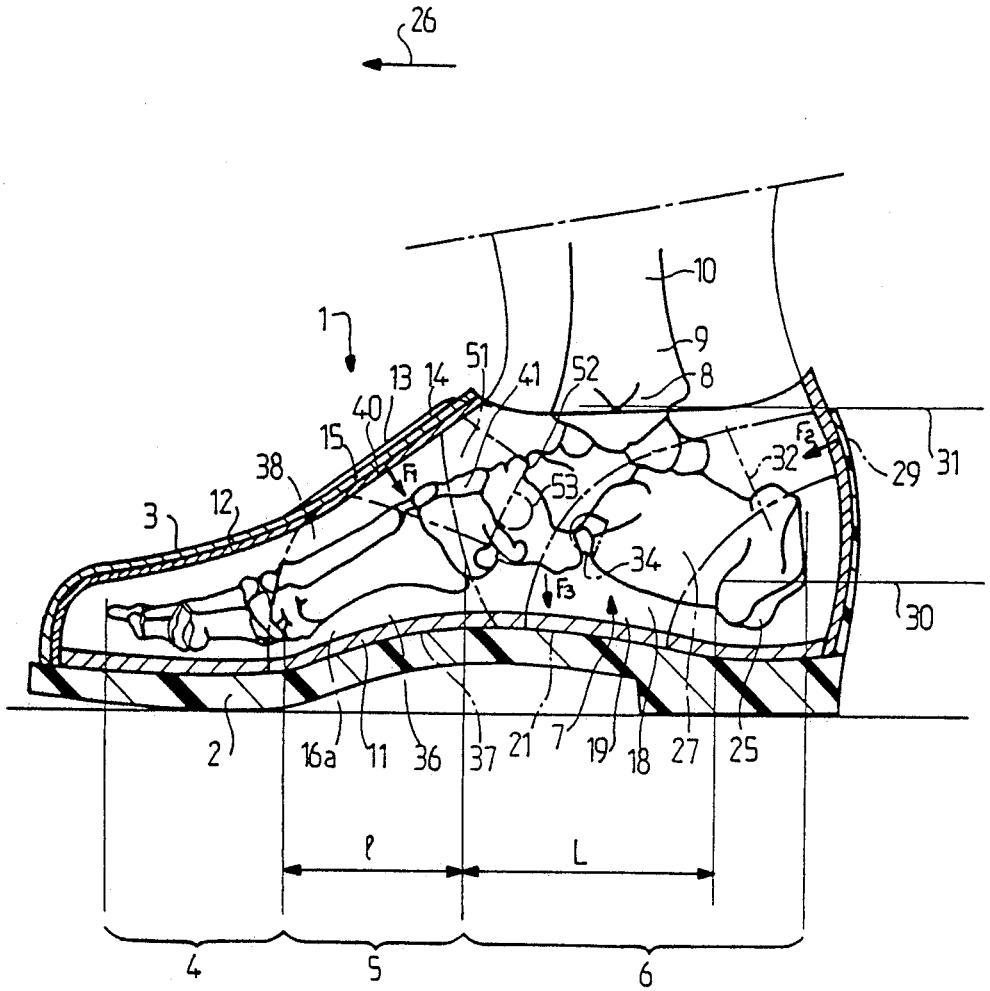
FIG. 4 illustrates the trajectory of the three flexible ties with respect to the foot bones, with a view of the shoe in FIG. 1 in cross section along a median vertical plane; the shoe is assumed to be resting on a horizontal plane in its normal position for use.

More specifically, in the example illustrated, and as shown more specifically in FIG. 4, each of the lateral zones 21 and 23 (not shown in FIG. 4) extends approximately, towards the rear, from a level immediately behind the metatarsal level 5 to a level immediately in front of the calcaneum 25, and the fastening of the end 19 and 20 of the strap forming the flexible tie 18 is done preferably over the entire length of the lateral zones 21 and 23 thus defined.

Figure 6:
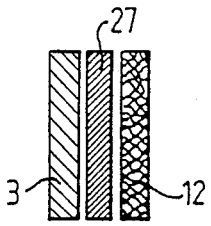

From these ends 19 and 20, the strap comprising the flexible tie 18 has two end sections 27, 28, each of which is housed between the upper 3 and the lining 12, as shown in FIG. 6, and each of these sections 27 and 28 ascends towards the rear from the respective corresponding end 19, 20, while remaining at a level under that of the malleoli 8 as shown in FIG. 4. Towards the rear, the two sections 27 and 28 connect to a third section 29 which fastens them together behind the upper, between a lower limit level 30 defined by the lower level of the lower attachment of the Achilles tendon on the calcaneum 25, and an upper limit level 31 defined by the lower level of the malleoli 8. The third section 29 preferably culminates in the immediate proximity of this upper limit level 31, under which the strap constituting the flexible tie 18 is also integrally located.

Figure 5:
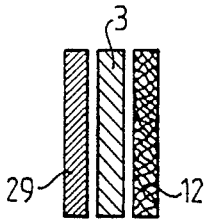
FIGS. 5 and 6 are views of the shoe in FIG. 1, in cross section along transverse planes labeled respectively V—V and VI—VI in FIG. 1.

In the case of the embodiment in FIG. 1 and as shown in FIG. 5, the third section 29 is outside of the shoe, to be applied to the foot from the rear through the intermediary of the upper 3 and the lining 12, while only the lining 12 separates the foot from sections 27 and 28. For this purpose, the upper 3 has, behind the level of the malleoli 8, respectively on the first side 22 of the shoe and the second side 24 thereof, two slits 32 and 33 allowing the strap forming the flexible tie 18 to slide freely, respectively at the intersection of section 27 with section 29, and at the intersection of section 28 with said section 29. Generally, excepting at the level of its ends 19 and 20 connecting with the sole 2, the strap constituting the flexible tie 18 remains totally independent from the upper 3 as well as the lining 12.

Figure 2:
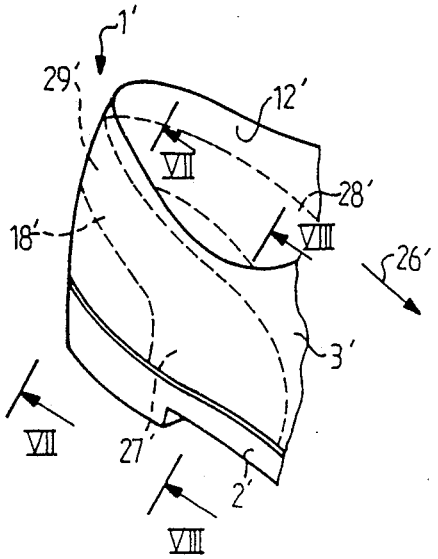
FIG. 2 is a view similar to that in FIG. 1, but partial, of a second embodiment of such a shoe.
Figure 3:
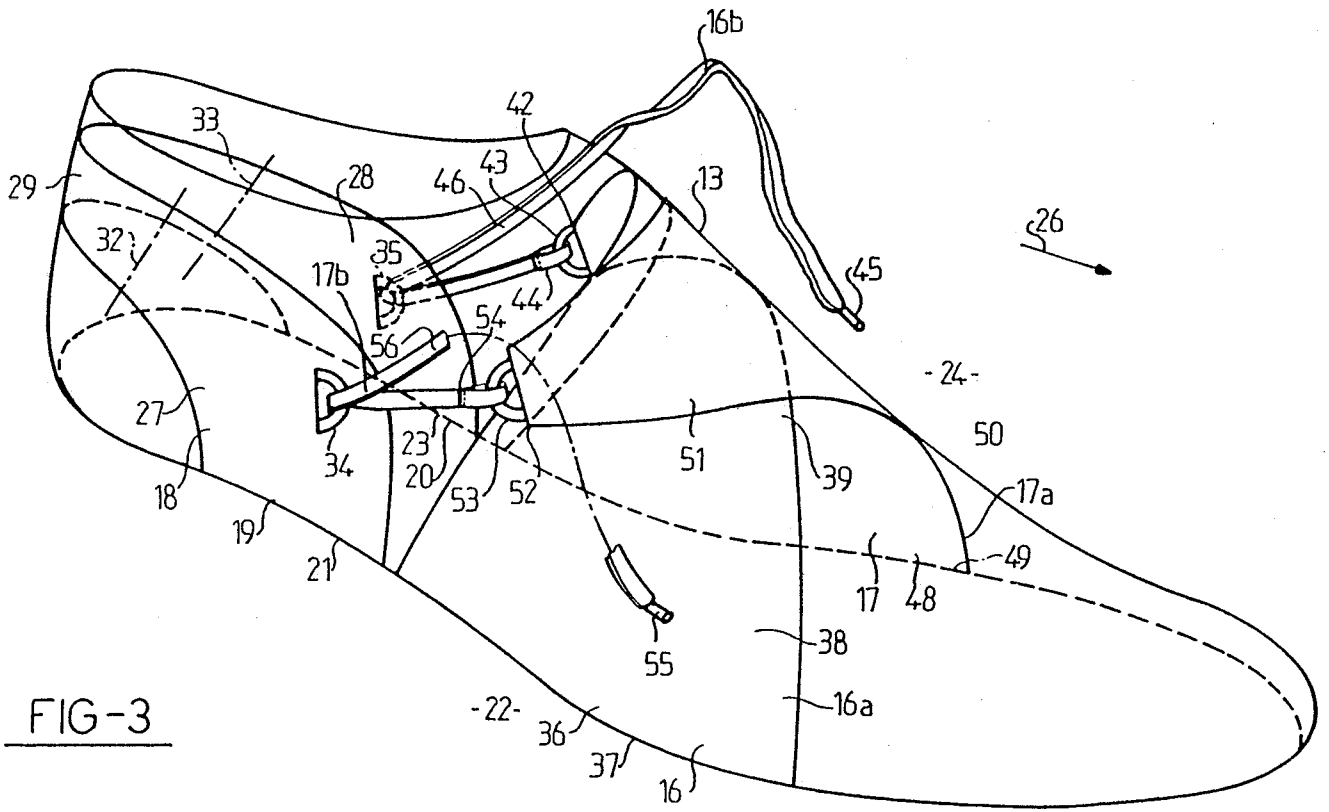
FIG. 3 is a perspective view of the arrangement involving the first, second and third flexible ties.
Figure 7:
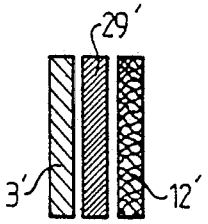
FIGS. 7 and 8 are views of the shoe illustrated in FIG. 2 in cross section along transverse planes respectively labeled VII—VII and VIII—VIII in FIG. 2; these planes are placed, with relation to the shoe in FIG. 2, respectively like the planes labeled V—V and VI—VI for the shoe illustrated in FIG. 1.
Figure 8:
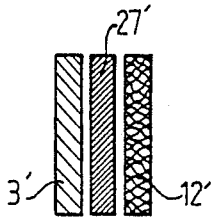

The embodiment in FIG. 2 differs from that in FIG. 1 only by the absence of any slit corresponding to slits 32 and 33, so that, with the exception of such slits, one finds the same elements in FIG. 2 as in FIG. 1, with the same reference numerals, but primed. In the case of this embodiment, the strap comprising the flexible tie 18' is housed between the upper 3' and its lining 12' not only for the sections thereof 27' and 28' adjacent to its ends connected with the sole 2' of the shoe 1' as shown in FIG. 8, but also for section 29', connecting sections 27' and 28' towards the rear, as seen in FIG. 7.

Approximately perpendicular to the malleoli 8, under the level of the latter and inside the shoe, each of the sections 27 and 28 and, in a manner which is not illustrated, each of the sections 27' and 28', has a respective guide 34, 35 of deviation and sliding respectively for flexible tie 17 and for flexible tie 16, as described below. In the illustrated example, each of the guides 34, 35 is located approximately at the midpoint between the malleoli 8 and the fastening ends 19, 20 of the strap constituting the flexible tie 18 with the sole 2.

Of course, a different position of guides 34 and 35 may also be chosen without departing from the framework of this invention, since this positioning would produce the effect of simultaneously tightening the three flexible ties 16, 17 and 18, which will be described below; the positioning of the guides 34 and 35 for this purpose will, however, remain generally similar to that described.

Unlike the flexible tie 18, each of the flexible ties 16 and 17 has only one fastening end with the sole 2 of the shoe 1, while it also has a free end.

More specifically, the flexible tie 16 has a first end 36 which is located inside the shoe, preferably between the lining 12 and the upper 3, as is the case in the example illustrated, and which constitutes one end of the strap 16a comprising in this preferred example a part of the flexible tie 16; this first end 36 is attached to the sole 2 along a lateral zone 37 thereof, on the first side 22 of the shoe 1. When, as illustrated, the first end 36 of the flexible tie 16 is defined by a strap 16b, the lateral zone 37, over the entire length of which this end 36 is advantageously attached to the sole 2, is located substantially at the metatarsal level 5 of the foot 7, as shown in FIG. 4, and extends approximately over the entire length 1 of this metatarsal 7, naturally, in the same manner as the first end zone 36 of the flexible tie 16.

Figure 9:
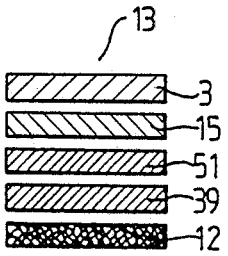
FIGS. 9 to 12 illustrate four variations of a view of the shoe in FIG. 1 in cross section along a transverse plane labelled IX—IX in FIG. 1; cross section views along planes arranged in the same manner for a shoe of the type illustrated in FIG. 2 would be identical.
Figure 10:
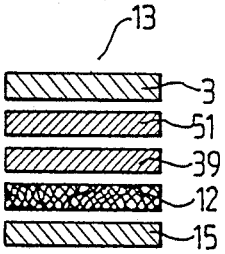

Beginning with the first end 36, the strap 16b defines two successive sections of the flexible tie 16, advantageously located between the lining 12 and the upper 3 while remaining independent of the latter, namely:

a first section 38 ascending from the first end 36, at the level of the metatarsal 5, to which it conforms preferably over a maximum of the length 1 thereof;

a second section 39 bypassing the instep 40 at the level of the metatarsal 5, to which this section 39 conforms preferably over a maximum of its length 1, at least from the section 38 to the crossing of a median longitudinal vertical plane of the shoe, i.e., approximately up to the level of the slit 14 of the upper 3 thereof; as seen in FIG. 9, the section 39 can be inserted at this level between the tongue 15, in this case running directly along the upper 3 inside the shoe, and the lining 12 placed so that it is directly contiguous to the foot; it can also be provided for the tongue 15 to be contiguous to the foot, under the lining 12; in this case the section 12 is inserted at this level between this lining 12 and the upper 3 to press against the foot through the intermediary of both the lining 12 and the tongue 15, as shown in FIG. 10; from the second side 24 of the shoe 1, the second section 39 turns towards the rear so that it overlaps the level of the metatarsal 5 and that of the cuneiform 41, up to a second end 42 of the strap 16*a*. This second end 42 is located approximately along the cuneiform 41, opposite the guide 35 carried by the section 28 of the strap constituting the flexible tie 18, while at the same time being offset towards the front and upward with respect to this guide 35, while being located at a level under that of the malleoli 8.

The second end 42 of the strap 16a holds in a solidary manner, opposite the guide 35, a ring 43, also offset towards the front and upwards with respect to the guide 35, while being located at a lower level than that of the malleoli 8. This ring 43 fastens the second end 42 of the strap 16*a* with a first end 44 of the lace 16*b*, a second end of which defines the free end 45 of the flexible tie 16.

Between its end 44 and its end defining the second end 45 of the flexible tie 16, the lace 16b engages freely between the lining 12 and the upper 3 of the shoe, in the guide 35 up to which it thus completes the second section 39 of the strap 16*a*, while remaining independent of the lining 12 as well as the upper 3 of the shoe 1.

The lace 16*b* can slide freely inside the guide 35 which turns it, so that, between the guide 35 and the second end 45 of the flexible tie 16, the lace 16*b* has a section 46 which partially bypasses the upper, i.e., also the foot, by the front, for example, at the level of the instep 40.

This bypassing of the upper and the foot by the section 46 can be free, or guided by at least one sliding guide. For example, according to one especially advantageous embodiment which has been illustrated, in the upper, in the immediate proximity of the slit 14 and on the upper part thereof, on the second side 24 of the shoe 1, an eyelet 47 is provided, in which the lace 16*b* is guided sliding freely and by which this lace 16*b* issues from the upper 3, while it is housed freely between the upper 3 and the lining 12 from the guide 35 up to the eyelet 47. From this eyelet 47 up to the second end 45 of the flexible tie 16, the lace 16*b* is thus outside of the shoe. According to one embodiment (not illustrated), lace 16*b* may issue from the intermediary space between the upper 3 and the lining 12 through an eyelet of the latter, situated like eyelet 47, and to freely overlap the tongue 15 inside the shoe up to another eyelet passing through the lining 12 and the upper 3 on the other side of the slit 14, directly opposite the position of eyelet 47, to subsequently issue from the shoe, sliding feeely in this eyelet.

The structure and arangement of the flexible tie 17 are similar to those of the flexible tie 16, beginning with a first end 48, which is defined by the strap 17a and by means of which the flexible tie 17 is fastened to the sole 2, along a lateral zone 49 thereof located opposite the lateral zone 37, i.e., on the second side 24 of the shoe 1, preferably between the lining 12 and the upper 3. The end 48 of the strap 17a and the lateral zone 49 over the entire length of which this end 48 is preferably fastened made fast with the sole 2, extending to the level of the metatarsal 5, over approximately the entire length 1 of the latter.

Beginning with the first end 48, the strap 17a successively comprises the following:

a first section 50 running along the inside of the shoe between the upper 3 and the lining 12 and being independent of the latter components; this first section 50, ascending from the first end 48, is in all aspects comparable to the first section 38 of the strap 16*a* and, especially, extends like the latter approximately over the entire length 1 of the metatarsal 5;

a second section 51 which is turned with respect to the first section 50, to bypass the instep 40, being superposed partially over the second section 39 of the strap 16*a*, of which the strap 17*a* nonetheless remains independent, just as it is independent of the upper 3, the lining 12 and the tongue 15. In the embodiment illustrated in FIG. 9, the second section 51 of the strap 17*a* is thus inserted between the second section 49 of the strap 16*a* and the tongue 15, whereas, in the case of the embodiment illustrated in FIG. 10, the second section 51 of the strap 17*a* is inserted between the second section 49 of the strap 16*a* and the upper 3. Advantageously, the second section 51 of the strap 17a covers the metatarsal 5 on a maximum of the length 1 thereof at least from the first section 50 up to the crossing of the longitudinal median plane of the shoe, so that the respective second sections 39 and 51 of the straps 16*a* and 17*a* complement each other respectively on each side of this longitudinal median plane, to best cover the instep 40. On the first side 22 of the shoe 1, the second section 51 of the strap 17a turns towards the rear to overlap the level of the metatarsal and that of the cuboid on the first side 22 of the shoe, where the strap 17*a* has a second end 52 which in all points is similar to the second end 42 of the strap 16*a* and, like the latter, carries a ring 53 placed opposite the guide 34 while being offset towards the front and upward with respect to the latter, while remaining at a level under that of the malleoli 8.

The ring 53 fastens the end 52 of the strap 17*a* with a first end 54 of the lace 17*b*, which also engages in a freely sliding manner in the guide 34, between the lining 12 and the upper 3 from which it is independent, to place between this guide 34 and a second end 55 constituting the free end of the flexible tie 17 a section 56 to partially bypass the instep 40, at least on the first side 22 of the shoe, so that, when laces 16*b* and 17*b* are tied together, their respective sections 46 and 56 complement each other to bypass the instep 40 between guides 34 and 35.

For this purpose, the lace 17*b* is mounted in the same manner as lace 16*a*; in other words, its section 56 extends between the lining 12 and the upper, independently of the latter components, from the guide 34 to an eyelet 57 passing through the upper 3 on the first side 22 of the shoe, in the immediate proximity of the slit 14 and in the upper part thereof, and the lace 17b passes sliding freely through the eyelet 57 so that its end 55 is located outside of the shoe and can be tied with the lace 16b outside of this shoe. Of course, a different assembly may also be adopted, which would allow sections 46 and 56 of laces 16*b* and 17*b* to be tied together between guides 34 and 35. For example, if the variant described above is adopted for the lace 16*b*, involving an overlapping of the tongue 15 by the lace 16*b*, lace 17b could issue from the intermediary space between the lining 12 and the upper 3 through an eyelet placed like the eyelet 57, but in the lining 12, and could subsequently overlap the tongue 15 to pass through the entire lining 12 and the upper 3 through an eyelet placed as stated for the eyelet 47.

In both cases, it is noted that the tying together of section 46 and 56 of laces 16*b* and 17*b* ensures the closing of the slit 14 at least at the upper part thereof. Additional means can be provided for this purpose, just as total independence can be provided between the closing means for slit 14, comprised, for example, of other laces, and laces 16*b* and 17*b*, especially in the case of an assembly according to which sections 46 and 56 of laces 16*b* and 17*b* pass through the lining 12 through eyelets placed as stated for the eyelets 47 and 57, respectively, without subsequently passing back through the lining 12 and upper 3 complex, so that laces 16*b* and 17*b* are tied together between the tongue 15 and the upper 3.

It is also noted that, according to this invention, the tying together of sections 46 and 56 of laces 16*b* and 17*b*, since these sections 46 and 56 complement each other to bypass the foot by the front, for example, at the instep 40, ensures the tightening of the flexible tie 16, 17 and 18 ensemble, tending to bring together ring 53 and guide 34 on the first side 22 of the shoe, and ring 43 and guide 35 on the second side 24 of the shoe.

The result of this is the application of the respective forces $F_1$ and $F_2$ against the foot, respectively by the ensemble formed of the first corresponding sections 39 and 51 of straps 16*a* and 17*a*, and by section 29 of the strap comprising the flexible tie 18. The first of these forces descends backward, while the second descends forward, approximately in a vertical plane constituting the median longitudinal plane of the ski, and these two forces $F_1$ and $F_2$ result in a force $F_3$ which presses the foot 7 flat against the sole 2 through the intermediary of the insole 11, approximately perpendicular to the sole 2, with respect to which the foot is thus immobilized against forward or backward movements. The offsetting of fastening zones 21 and 23 of the strap comprising the flexible tie 18 with the sole 2 with respect to zones 37 and 49 for connecting straps 16*a* and 17*a* with the sole 2 also ensures that the foot is secured against lateral movements with respect to the sole 2, by simple translation as well as by rotation of the foot on itself. The result is an especially effective holding of the foot on the sole 2, without any adverse effects on the comfort of the shoe, considering that the foot is held essentially by straps, distributing the stress over the largest possible surface. However, one would not depart from the framework of this invention by making flexible ties 16, 17 and 18 totally in the form of laces, while preferably in this case maintaining indirect pressure of these laces on the foot, at least through the intermediary of the lining 12 of the shoe and, in a localized manner, through the intermediary of the tongue 15, for pressing flexible ties 16 and 17 against the instep 40 and through the intermediary of the upper 3 for the section 29 of the flexible tie 18.

It is also possible to make all of the flexible ties 16 and 17 in the form of straps, preferably tapered in their zones corresponding to laces 16*b* and 17*b* in the illustrated embodiment. In this case, the sections of these straps corresponding to sections 46 and 56 of laces 16*b* and 17*b* could be fastened together other than by tying, for example by using buckle systems or looped and hooked fabrics of the type marketed under the trademark "Velcro".

Figure 11:
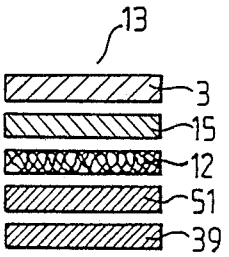
Figure 12:
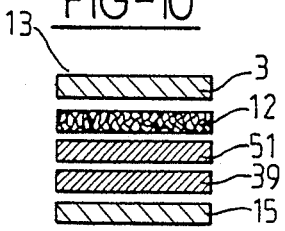

Moreover, although inserting the flexible ties 16, 17 and 18 between the upper 3 of the shoe and its lining 12 is preferred for the sections of these ties inside the shoe, the flexible ties 16, 17, 18 could be inserted between the lining 12 and the foot, or, in the absence of such a lining, directly between the upper 3 and the foot. FIGS. 11 and 12 illustrate such variations, in cuts made in the immediate proximity of the slit 14. In the case of FIG. 11, from the outside of the shoe towards the inside thereof is the succession of the upper 3, the tongue 15, the lining 12, section 51 of flexible tie 17 and section 39 of flexible tie 16, while, in the case of the variation in FIG. 12, the succession from the outside of the shoe to the inside thereof comprises the upper 3, its lining 12, section 51 of flexible tie 17, section 39 of flexible tie 16, and the tongue 15. Of course, regardless of the mode of assembly adopted for flexible ties 16, 17 and 18, and regardless of the structure of the latter, the implementation of the invention under optimum conditions assumes that, outside of their fastening zones to the sole 2, these flexible ties remain free to slide with respect to each other and to the other elements of the shoe, possibly in a guided manner for sections 46 and 56 of flexible ties 16 and 17 adjacent to their free ends 45 and 55, as permitted by eyelets 47 and 48 in the embodiment illustrated.

I claim:

1. In a sport shoe comprising a flexible upper (3, 3') and a sole (2, 2'), the improvement comprising means for securing a foot in said shoe (1, 1'), said securing means comprising (a) first and second flexible fastening ties (16, 17), each of said ties having a first end (36, 48) attached inside said shoe (1, 1'), in a lateral zone (37, 49) of said sole located respectively on a first (22) and a second (24) side of said shoe (1) at the level of the metatarsal (5), and successively, beginning with this first end (36, 48), a first section (38, 50) extending laterally along a foot (7) housed in said shoe (1, 1'), at the level of the metatarsal (5), inside said shoe (1, 1'), and independently of said upper (3, 3'), a second section (39, 51) bypassing an instep (40) respectively up to said second (24) or said first (22) side of said shoe (1), at the level of the metatarsal (5), inside said shoe (1) and independently of said upper (3, 3'), with said second sections (39, 51) of said first and second flexible fastening ties (16, 17), superposed freely over each other, and a second end zone (45, 46, 55, 56);

(b) means for selectively tightening and releasing said first and second flexible fastening ties (16, 17) by mutual movable fastening of their second end zones (45, 46, 55, 56);

(c) a third flexible fastening tie (18, 18'), having first and second ends (19, 20) attached inside said shoe (1, 1'), in lateral zones (21, 23) of said sole located respectively on said first (22) and second (24) sides of said shoe (1, 1'), behind the level of the metatarsal (5) and in front of the level of the calcaneum (25), first and second sections (27, 28, 27', 28') extending laterally along said foot (7), at least partially inside said shoe (1), and independently of said upper (3, 3'), respectively on said first (22) and second (24) sides of said shoe (1), and turning towards the rear respectively from said first (19) and second (20) ends of said third flexible tie (18, 18'), and a third section (29, 29') interconnecting said first and second sections (27, 28) of said third flexible tie (18, 18'), behind said upper (3, 3') and independently thereof, with said third section (29, 29') of said third flexible tie (18, 18') extending along said foot (7) by the rear between a lower limit level (30) defined by a lower level of the lower attachment of the Achilles tendon to the calcaneum (25) and an upper limit level (31) defined by the lower level of the malleoli (7); and (d) said tightening means comprise, on each of said first and second sections (27, 28, 27', 28') of said third flexible fastening tie (18, 18'), under the level of the malleoli (7) and inside said shoe (1, 1'), a respective guide (34, 35) for the corresponding deviation and sliding of said second (17) or said first (16) flexible fastening tie, such that said first and second flexible fastening ties (16, 17) have, between their second sections (39, 51) and their second end zones (45, 46, 55, 56), third sections (46, 56) which complement each other when said second end zones (45, 46, 55, 56) are fastened together, to bypass the foot (7) by the front between said guides (34, 35), tightening of said first and second flexible fastening ties (16, 17) also causing the tightening of said third flexible fastening tie (18, 18'), and said first and second flexible ties (16, 17) on the one hand, and said third flexible tie (18, 18') on the other hand, can apply the respective mutually convergent forces ($F^1$, $F_2$) against said foot (7), downwardly against said sole (2).

2. Shoe according to claim 1, wherein the upper (3, 3') comprises at least one sliding guide (47, 57) for said third section (46, 56) of at least one of said first and second flexible ties (16, 17) forwardly of said sliding and deviation guides (34, 35).

3. Shoe according to claim 1, wherein said upper (3, 3') comprises an opening slit (14) at the level of said instep (40) for putting said shoe on and taking it off, and wherein said upper (3, 3') comprises respectively, on both sides of said slit (14) and immediately adjacent thereto, at least two sliding guides (47, 57), respectively for said third (46, 56) sections of both said first and second flexible ties (16, 17), so that the tightening of the latter by fastening together their second end zones (45, 46, 55, 56) causes said slit (14) to close.

4. Shoe according to any one of claims 1 to 3, wherein said third flexible tie (18) passes through said upper (3) between said third section (29) and said sliding and deviation guides (34, 35), so that its third section (29) is outside of said shoe (3).

5. Shoe according to any one of claims 1 to 3, wherein said third flexible tie (18') is completely inside the shoe (1').

6. Shoe according to any one of claims 1 to 3, wherein said third flexible tie (18, 18') is a strap.

7. Shoe according to claim 6, wherein said first and second ends of said third flexible tie (18, 18') and the corresponding lateral zones (21, 23) of said sole extend approximately from the immediate proximity of the level of the metatarsal (5) to the immediate proximity of the level of the calcanem (25).

8. Shoe according to any one of claims 1 to 3, wherein at least said first and second sections (38, 39, 50, 51) of said first and second flexible ties (16, 17) are straps (16*a*, 17*a*).

9. Shoe according to claim 8, wherein said first ends (36, 48) of said first and second flexible fastening ties (16, 17) and the corresponding lateral zones (37, 49) of said sole extend approximately over the entire length (1) of the metatarsal (5).

10. Shoe according to any one of claims 1 to 3, wherein at least said third sections (46, 56) of said first and second flexible ties (16, 17) are laces (16*b*, 17*b*).

11. Shoe according to any one of claims 1 to 3, wherein said upper comprises a flexible inside lining (12, 12'), and wherein said first and second sections (38, 39, 50, 51) of said first and second flexible ties (16, 17) are inserted freely between said lining (12, 12') and said upper (3, 3').

12. Shoe according to any one of claims 1 to 3, wherein said upper (3, 3') comprises a flexible inside lining (12, 12') and wherein said sections (27, 28, 27', 28', 29') of said third flexible tie (18, 18') inside said shoe (1, 1') are inserted freely between said lining (12, 12') and said upper (3, 3').

13. Shoe according to any one of claims 1 to 3, wherein said upper (3, 3') comprises an opening slit (14) at said instep (40) for putting said shoe on and taking it off, and a flexible inside tongue (15) opposite said slit (14), and wherein said second sections (39, 51) of said first and second flexible ties (16, 17) are inserted between said tongue (15) and said upper (3, 3').

* * * * *